US011953215B2

(12) United States Patent
Bardia et al.

(10) Patent No.: US 11,953,215 B2
(45) Date of Patent: Apr. 9, 2024

(54) PANEL ARRANGEMENT FOR HVAC SYSTEM

(71) Applicant: Johnson Controls Tyco IP Holdings LLP, Milwaukee, WI (US)

(72) Inventors: Ashish Nandkumar Bardia, Pune (IN); Abhishek Gangaram Parab, Kudal (IN); Curtis Wayne Caskey, Norman, OK (US); Earl John Rightmier, Marcy, NY (US)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 49 days.

(21) Appl. No.: 17/592,385

(22) Filed: Feb. 3, 2022

(65) Prior Publication Data

US 2023/0296269 A1 Sep. 21, 2023

(51) Int. Cl.

| | |
|---|---|
| ***F24F 1/035*** | (2019.01) |
| ***F24F 1/0323*** | (2019.01) |
| ***F24F 1/28*** | (2011.01) |
| ***F24F 1/30*** | (2011.01) |
| ***F24F 13/28*** | (2006.01) |
| ***F24F 13/30*** | (2006.01) |

(52) U.S. Cl.

CPC ..... *F24F 1/035* (2019.02); *F24F 1/0323* (2019.02); *F24F 13/28* (2013.01); *F24F 13/30* (2013.01)

(58) Field of Classification Search

CPC ..... F24F 1/0073; F24F 1/035; F24F 13/28; F24F 13/30

See application file for complete search history.

(56) References Cited

U.S. PATENT DOCUMENTS

| | | | | |
|---|---|---|---|---|
| 5,573,059 | A * | 11/1996 | Hamamoto | F24F 1/0083 165/122 |
| 6,986,387 | B2 * | 1/2006 | Hancock | F24F 11/81 165/103 |
| 7,694,526 | B2 * | 4/2010 | Inoue | F24F 13/30 62/426 |
| 8,591,222 | B2 | 11/2013 | Sherrow | |
| 10,672,632 | B2 * | 6/2020 | Kawai | F24F 7/08 |
| 11,168,900 | B2 * | 11/2021 | Kimura | F24F 5/0092 |
| 2019/0257532 | A1 * | 8/2019 | Sakabe | F24F 1/0067 |

* cited by examiner

*Primary Examiner* — Christopher R Zerphey
(74) *Attorney, Agent, or Firm* — Fletcher Yoder, P.C.

(57) ABSTRACT

A heating, ventilation, and/or air conditioning (HVAC) unit includes a heat exchange section having a plurality of panels defining an air flow path through the heat exchange section. The air flow path includes an upstream portion and a downstream portion, the upstream portion has a first cross-sectional area, and the downstream portion has a second cross-sectional area greater than the first cross-sectional area.

18 Claims, 10 Drawing Sheets

PANEL ARRANGEMENT FOR HVAC SYSTEM

BACKGROUND

This section is intended to introduce the reader to various aspects of art that may be related to various aspects of the present disclosure and are described below. This discussion is believed to be helpful in providing the reader with background information to facilitate a better understanding of the various aspects of the present disclosure. Accordingly, it should be noted that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. An HVAC system may control environmental properties by controlling a supply air flow delivered to the environment. For example, the HVAC system may place the supply air flow in a heat exchange relationship with a refrigerant of a vapor compression circuit to condition the supply air flow. In some embodiments, the HVAC system include a filter system through which the supply air flow is directed to remove certain particles from the supply air flow. It may be desirable to direct the supply air flow through the filter system at a particular speed, such as below a threshold speed, to achieve a desired performance (e.g., efficiency) of the HVAC system.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heating, ventilation, and/or air conditioning (HVAC) unit includes a heat exchange section having a plurality of panels defining an air flow path through the heat exchange section. The air flow path includes an upstream portion and a downstream portion, the upstream portion has a first cross-sectional area, and the downstream portion has a second cross-sectional area greater than the first cross-sectional area.

In one embodiment, a heat exchange section of a heating, ventilation, and/or air conditioning (HVAC) unit includes a plurality of panels defining an air flow path through the heat exchange section, an upstream portion of the air flow path defined by the plurality of panels, a downstream portion of the air flow path defined by the plurality of panels, and a heat exchanger disposed within the air flow path. The upstream portion comprises a first cross-sectional area, the downstream portion comprises a second cross-sectional area greater than the first cross-sectional area of the upstream portion, and the heat exchanger extends within the upstream portion and the downstream portion.

In one embodiment, a heating, ventilation, and/or air conditioning (HVAC) unit includes a first panel defining an upstream portion of an air flow path through a heat exchange section of the HVAC unit and a second panel defining a downstream portion of the air flow path. The upstream portion includes a first cross-sectional area, and the downstream portion includes a second cross-sectional area greater than the first cross-sectional area. The second panel extends from the first panel at an oblique angle.

DRAWINGS

Various aspects of this disclosure may be better understood upon reading the following detailed description and upon reference to the drawings in which.

DETAILED DESCRIPTION

Figure 1:
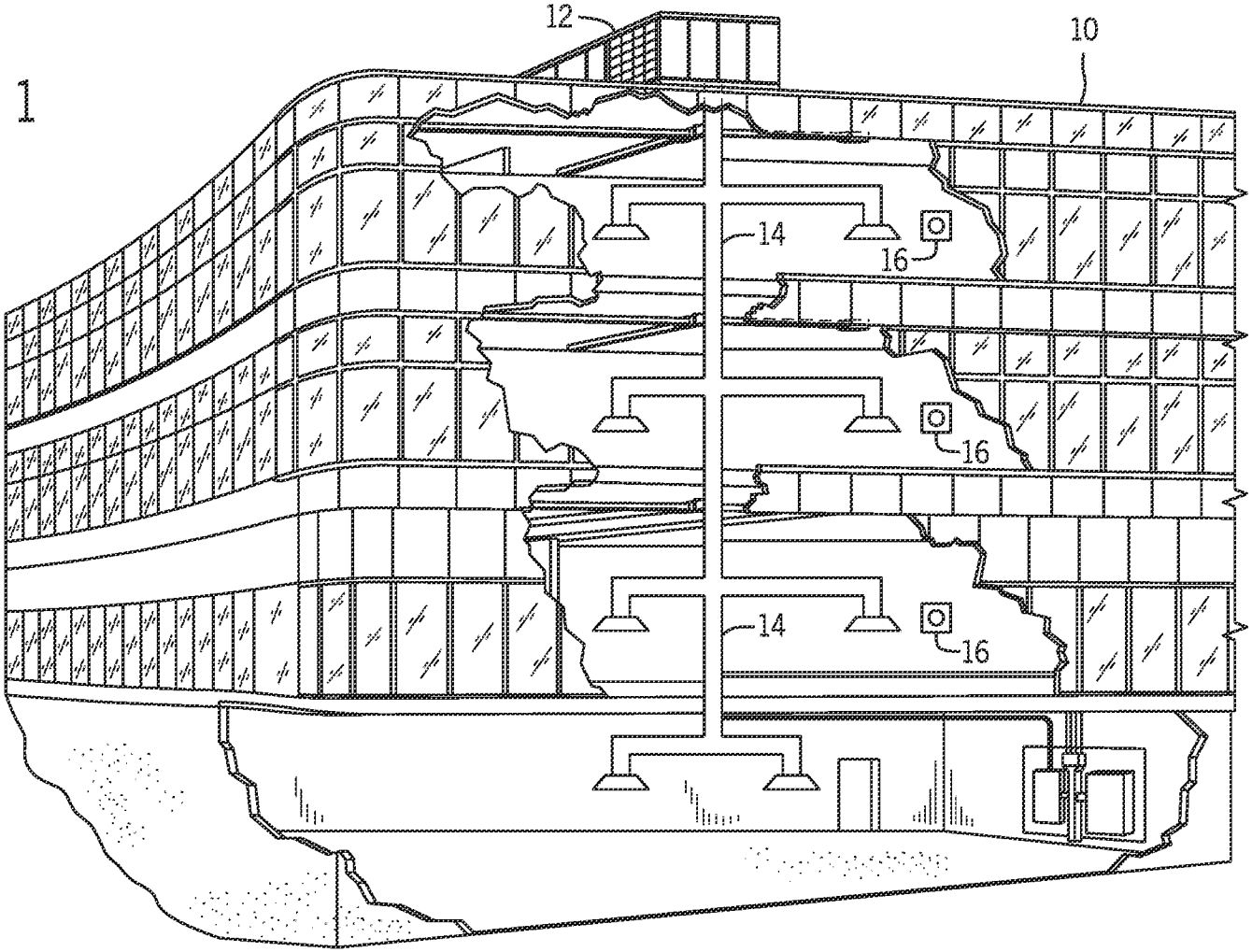
FIG. 1 is a perspective view of an embodiment of a heating, ventilation, and/or air conditioning (HVAC) system for environmental management that may employ one or more HVAC units, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure is directed to a heating, ventilation, and/or air conditioning (HVAC) system. The HVAC system may be configured to operate to condition a space. For example, the HVAC system may be configured to heat and/or cool the space to a target or set point temperature value or other operating parameter value by conditioning an air flow and controlling supply of the air flow to the space. To this end, the HVAC system may be configured to direct the air flow through a heat exchange section, which may place the air flow in a heat exchange relationship with a conditioning fluid (e.g., a refrigerant, combustion products) via a heat exchanger to condition the air flow. Subsequently, the air flow may be directed to the space to condition the space. In some embodiments, the HVAC system may also include one or more filters through which the air flow may be directed. The filters may be configured to remove particles, such as dust, debris, contaminants, and the like, contained with the air flow to improve a quality of the air flow being directed to the space.

In certain embodiments, the air flow may be directed at a target speed through the heat exchange section to enable efficient heat exchange between the air flow and the heat exchanger disposed in the heat exchange section to condition the air flow. As a result, however, the air flow may be directed through one or more of the filters at an elevated speed that may cause increased wear of the filters. For example, a blower may be configured to direct the air flow to the heat exchange section and then to the filters. The blower may operate to direct the air flow through the heat exchange section at the target speed, and a resulting discharge speed of the air flow from the heat exchange section to the filters may be above a threshold or desired speed, which may cause increased wear of the filters. For this reason, maintenance may be frequently performed on the HVAC system, such as to repair, replace, and/or remove the filters, thereby reducing efficient operation of the HVAC system.

Thus, it is presently recognized that limiting the speed of the air flow directed through the filters may improve operation of the HVAC system, such as by reducing wear of the filters. Accordingly, embodiments of the present disclosure are directed to a heat exchange section that includes panels arranged to reduce the speed of the air flow directed through (e.g., discharged from) the heat exchange section toward the filters. For example, the panels may include upstream panels that define an upstream portion of an air flow path through the heat exchange section, and the panels may include downstream panels that define a downstream portion of the air flow path. The upstream portion defined by the upstream panels has a first cross-sectional area, and the downstream portion defined by the downstream panels has a second cross-sectional area that is greater than the first cross-sectional area. The relatively larger cross-sectional area of the downstream portion may reduce (e.g., substantially reduce) the speed of the air flow directed through the heat exchange section, such as from the upstream portion to the downstream portion. For example, the panels may enable the air flow to enter the heat exchange section at the target speed and exit the heat exchange section at a speed below the threshold speed. As such, the air may also flow through the filters at a speed below the threshold speed and avoid undesired wear or degradation of the filters. In this way, the disclosed structure of the heat exchange section may enable improved operation of the HVAC system. For example, the flow of air at the target speed into the heat exchange section may enable efficient heat exchange between the air flow and a heat exchanger disposed within the heat exchange section. Additionally, the reduced speed of air flow through the filters may reduce wear of the filters. Thus, maintenance operation or service to mitigate or rectify wear of the filters may be performed less frequently, and the HVAC system may therefore operate more efficiently.

As used herein, the terms "approximately," "generally," "substantially," and so forth, are intended to convey that the property value being described may be within a relatively small range of the property value, as those of ordinary skill would understand. For example, when a property value is described as being "approximately" equal to (or, for example, "substantially similar" to) a given value, this is intended to convey that the property value may be within +/−5%, within +/−4%, within +/−3%, within +/−2%, within +/−1%, or even closer, of the given value. Similarly, when a given feature is described as being "substantially parallel" to another feature, "generally perpendicular" to another feature, and so forth, this is intended to convey that the given feature is within +/−5%, within +/−4%, within +/−3%, within +/−2%, within +/−1%, or even closer, to having the described nature, such as being parallel to another feature, being perpendicular to another feature, and so forth. Mathematical terms, such as "parallel" and "perpendicular," should not be rigidly interpreted in a strict mathematical sense, but should instead be interpreted as one of ordinary skill in the art would interpret such terms. For example, one of ordinary skill in the art would understand that two lines that are substantially parallel to each other are parallel to a substantial degree, but may have minor deviation from exactly parallel.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
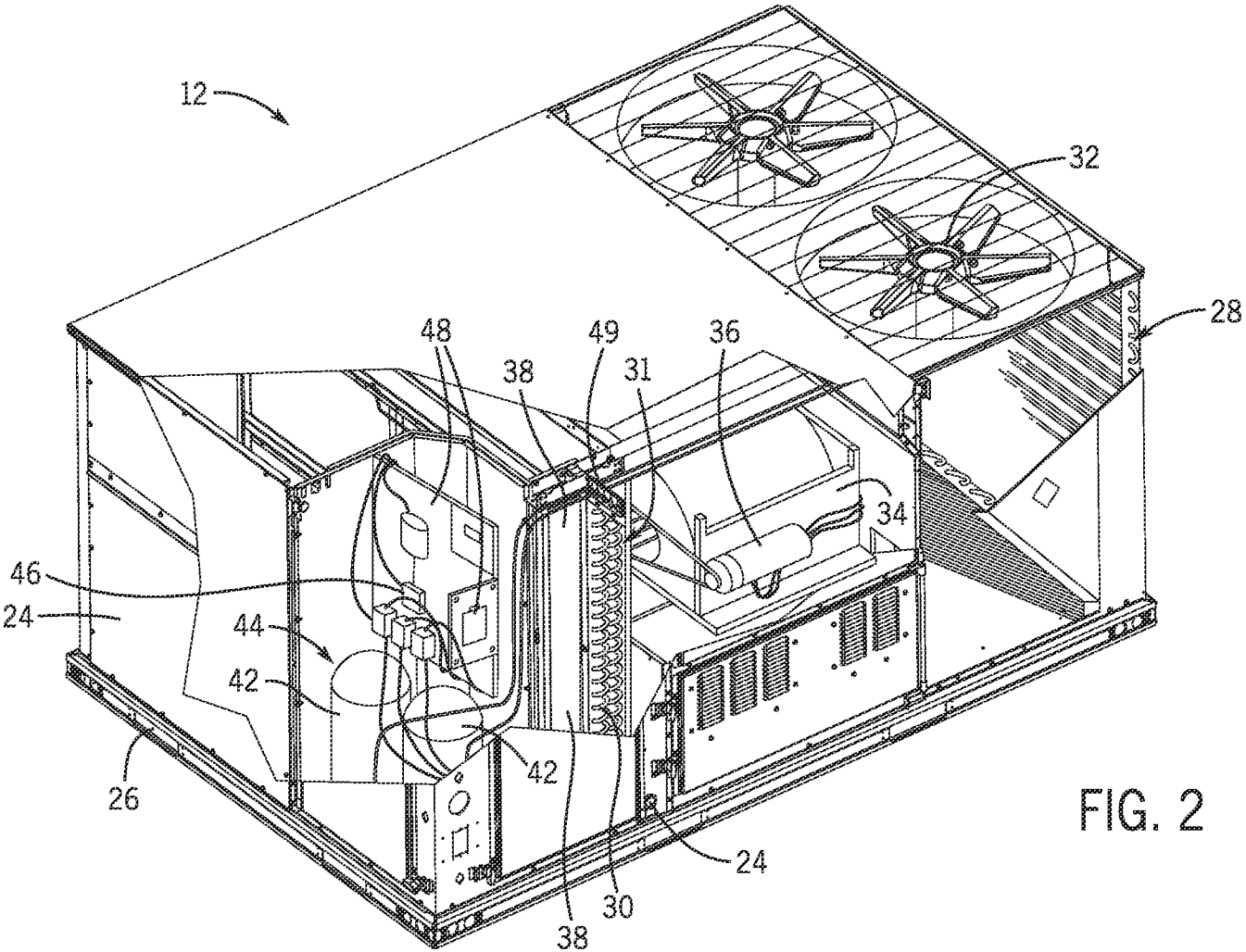
FIG. 2 is a perspective view of an embodiment of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit onto "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. Additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
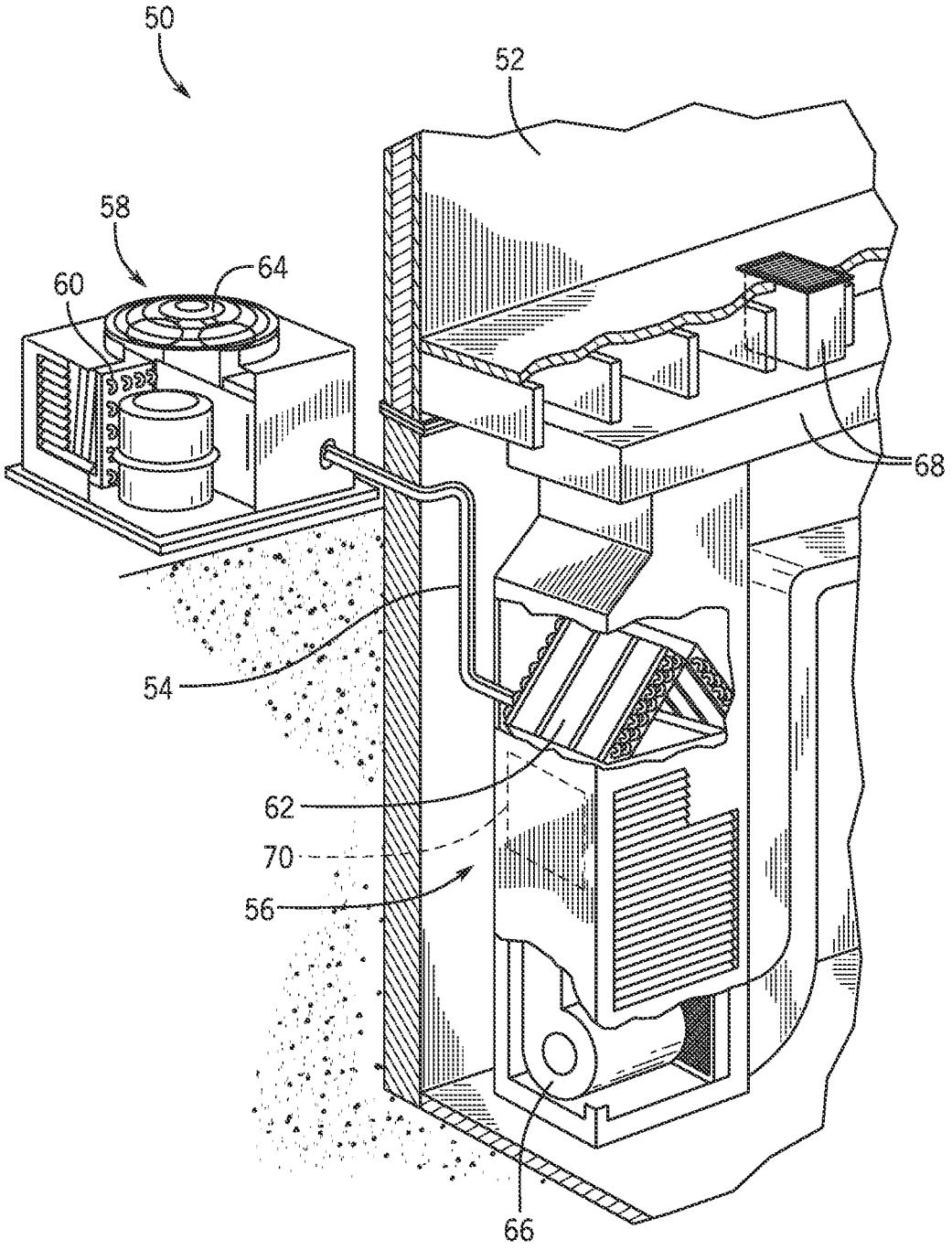
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
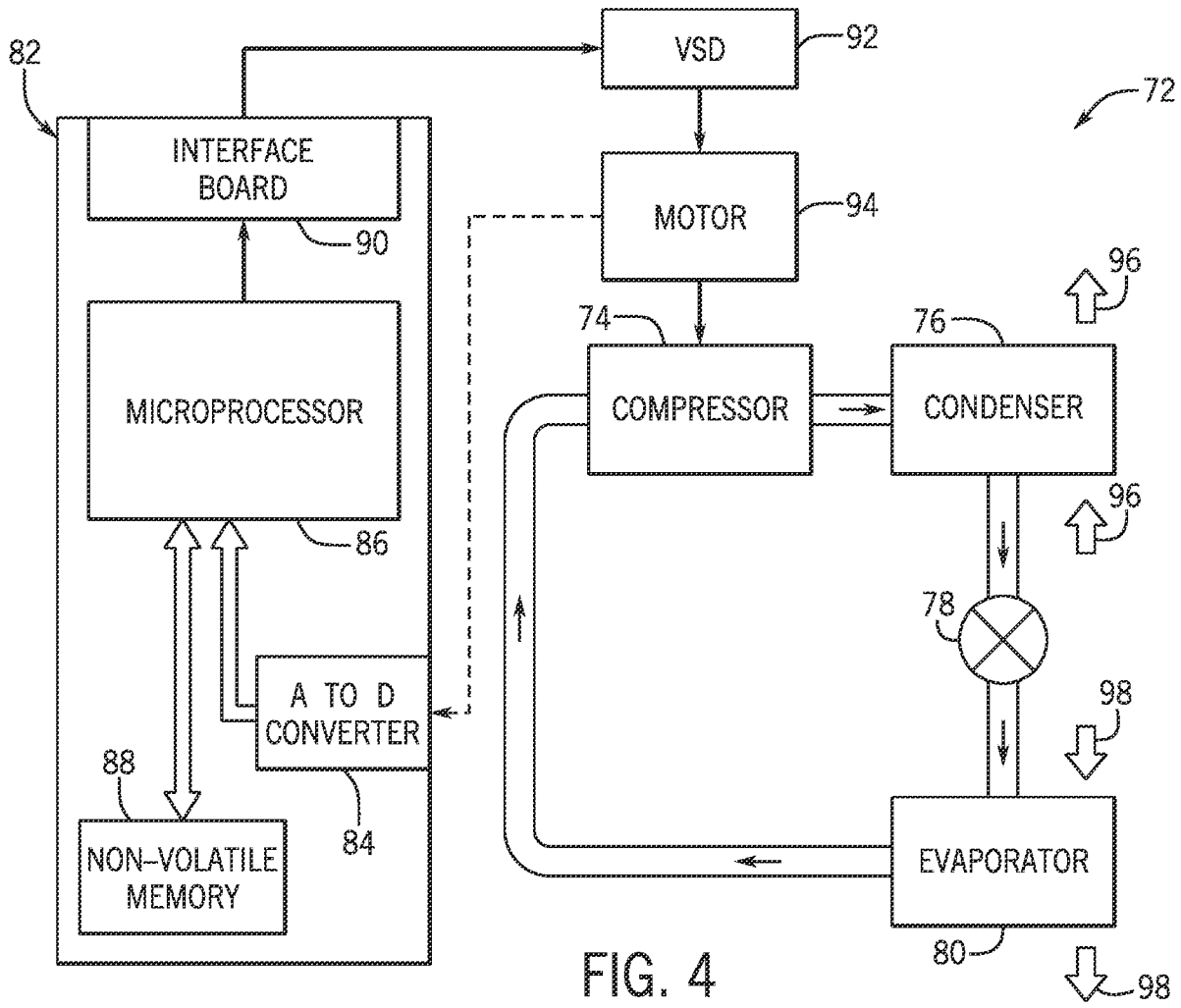
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

Any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

The present disclosure is directed to an HVAC system that includes panels arranged to reduce a speed of an air flow directed from a heat exchange section to a filter section of the HVAC system. For example, the panels may define an air flow path through the heat exchange section. Upstream panels may define an upstream portion of the air flow path, downstream panels may define a downstream portion of the air flow path, and the downstream portion may have a cross-sectional area that is greater than a cross-sectional area of the upstream portion. In some embodiments, the downstream panels may include a side panel (e.g., a downstream side panel) that extends obliquely (e.g., at an angle) from a side panel (e.g., an upstream side panel) of the upstream panels to increase the cross-sectional area of the downstream portion relative to the upstream portion. Additionally or alternatively, the upstream panels may include an upper panel (e.g., an upstream upper panel) and a lower panel (e.g., an upstream lower panel) that are respectively offset from an upper panel (e.g., a downstream upper panel) and a lower panel (e.g., a downstream lower panel) of the downstream panels to form the increased cross-sectional area of the downstream portion relative to the upstream portion. The increased cross-sectional area of the downstream portion may reduce the speed of the air flowing through the heat exchange section prior to the air flow reaching the filter section. As a result, the air flow may be discharged from the heat exchange section to the filter section at a reduced speed, such as a speed that is below a threshold speed. The flow of air directed to the filter section at the speed below the threshold speed may limit wear of one or more filters positioned within the filter section. Therefore, the disclosed arrangement of the panels may improve a structural integrity of the filter section, increase a useful life of the filters, and/or improve performance, such as an efficiency, of the HVAC system.

Figure 5:
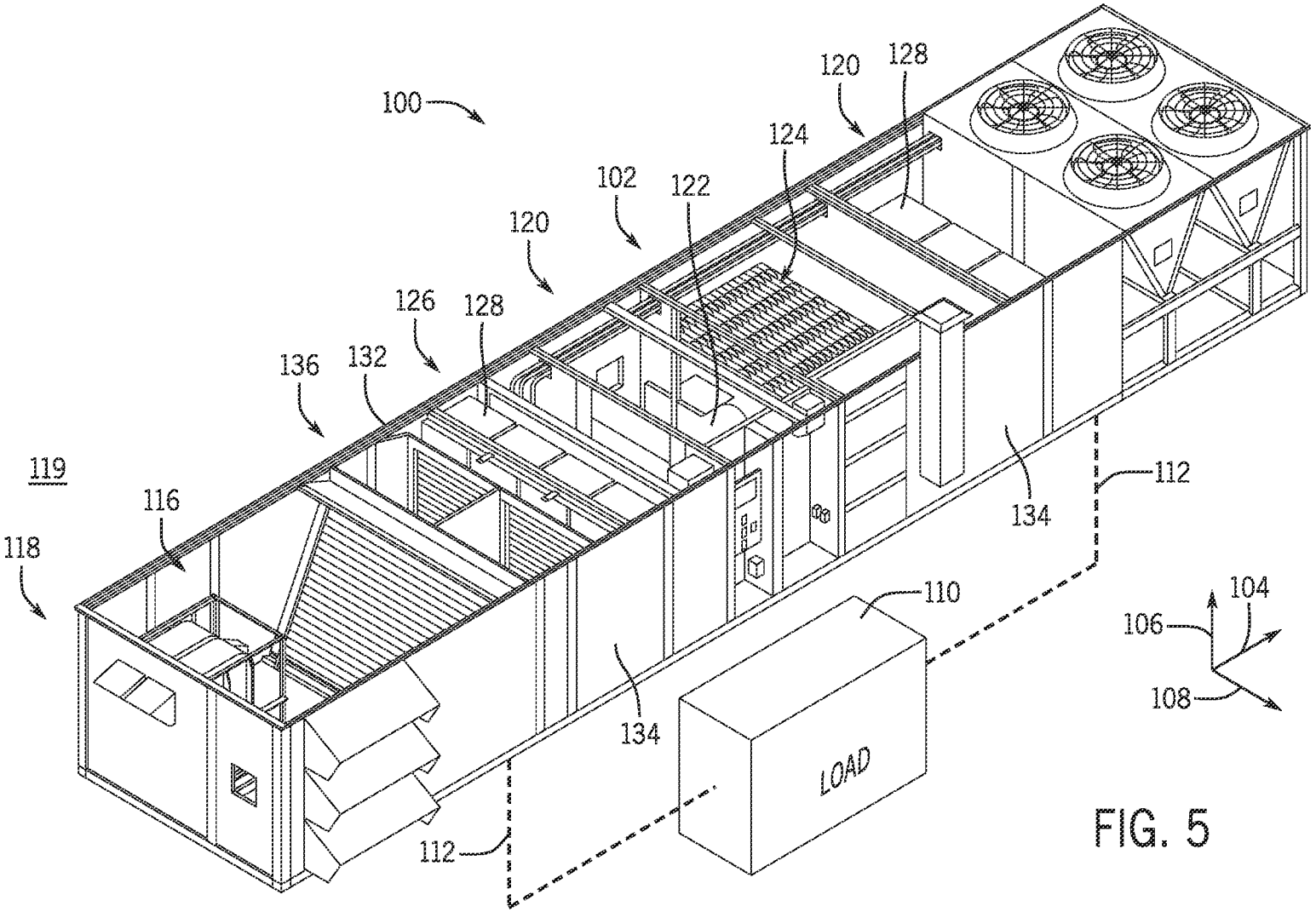
FIG. 5 is a perspective view of an embodiment of an HVAC system with a heat exchange section, in accordance with an aspect of the present disclosure.

With this in mind, FIG. 5 is a perspective view of an embodiment of a heating, ventilation, and/or air conditioning (HVAC) system or unit 100 having a heat exchange section 102. It should be noted that the HVAC system 100 may include embodiments or components of the HVAC unit 12 shown in FIG. 1, embodiments or components of the residential heating and cooling system 50 shown in FIG. 3, a rooftop unit (RTU), or any other suitable HVAC system. To facilitate discussion, the HVAC system 100, the heat exchange section 102, and their respective components will be described with reference to a longitudinal axis 104, a vertical axis 106 (e.g., oriented relative to gravity), and a lateral axis 108.

The HVAC system 100 may be configured to circulate a flow of conditioned air through a load 110, such as a conditioned space within a building, residential home, or any other suitable structure. The load 110 is in fluid communication with the HVAC system 100 via an air distribution system 112, represented by dashed lines, which may include ductwork configured to facilitate the supply and extraction of air from one or more rooms or spaces of the load 110. The HVAC system 100 may also include a vapor compression system, such as the vapor compression system 72, which enables the HVAC system 100 to regulate one or more climate parameters within the load 110. For example, the HVAC system 100 may be configured to condition and provide an air flow to the load 110 to achieve a desired air quality, air humidity, and/or air temperature within the load 110.

As shown in the illustrated embodiment, the HVAC system 100 includes an intake section 116, which forms an end portion 118 of the HVAC system 100. The intake section 116 may receive intake air, which may include return air from the load 110 (e.g., via the air distribution system 112) and/or ambient air from an ambient environment 119. Indeed, the intake section 116 may combine return air and ambient air, such as by discharging or exhausting a portion of the return air from the load 110 to the ambient environment 119, in order to produce intake air having a desirable mixture of return air and ambient air. The HVAC system 100 may condition the intake air for delivery to the load 110 as supply air. For example, the illustrated HVAC system 100 may include a blower section 120 having one or more fans 122 configured to force (e.g., draw, blow) the intake air through the heat exchange section 102. The heat exchange section 102 may condition the intake air, such as by changing a temperature and/or humidity of the intake air, to generate the supply air. As an example, the heat exchange section 102 may include a heat exchanger 124 configured to place the intake air in a heat exchange relationship with a conditioning fluid (e.g., a refrigerant, combustion products) to condition the intake air via the conditioning fluid. In some embodiments, the heat exchange section 102 may be configured to increase a temperature of the intake air, such as via a heated fluid. In some embodiments, the heat exchanger 124 may be a furnace configured to circulate combustion products to enable heating of the intake air to generate the supply air. In additional or alternative embodiments, the heat exchange section 102 may be configured to reduce a temperature of the intake air, such as via a cooled fluid. In any case, after conditioning the intake air to generate the supply air, the HVAC system 100 may deliver the supply air to the load 110 to condition the load 110.

The HVAC system 100 may also include one or more filter sections 126 configured to improve a quality of the air (e.g., the intake air, the supply air) directed through the HVAC system 100. For example, the filter section 126 may include an array of filters 128 (e.g., one or more filters) configured to enable flow of air through the array of filters 128 and the HVAC system 100. The array of filters 128 may entrap particles, such as dust, debris, impurities, and/or contaminants, contained within the air flowing through the array of filters 128 to block the particles from being directed to other components of the HVAC system 100 and/or to the load 110. In this manner, the filter section(s) 126 may maintain a desirable operation (e.g., efficiency, conditioning) of the HVAC system 100 and enable desired conditioning of the load 110.

The HVAC system 100 may also include a housing 132, which may define each of the heat exchange section 102, the intake section 116, the blower section 120, and the filter section(s) 126. For example, the housing 132 may include a plurality of outer panels 134 that define an internal volume 136, and each of the heat exchange section 102, the intake section 116, the blower section 120, and the filter section(s) 126 may be positioned within the internal volume 136. The HVAC system 100 may direct air through the housing 132 to flow sequentially through the intake section 116, the blower section 120, the heat exchange section 102, and the filter section 126, for example.

Figure 6:
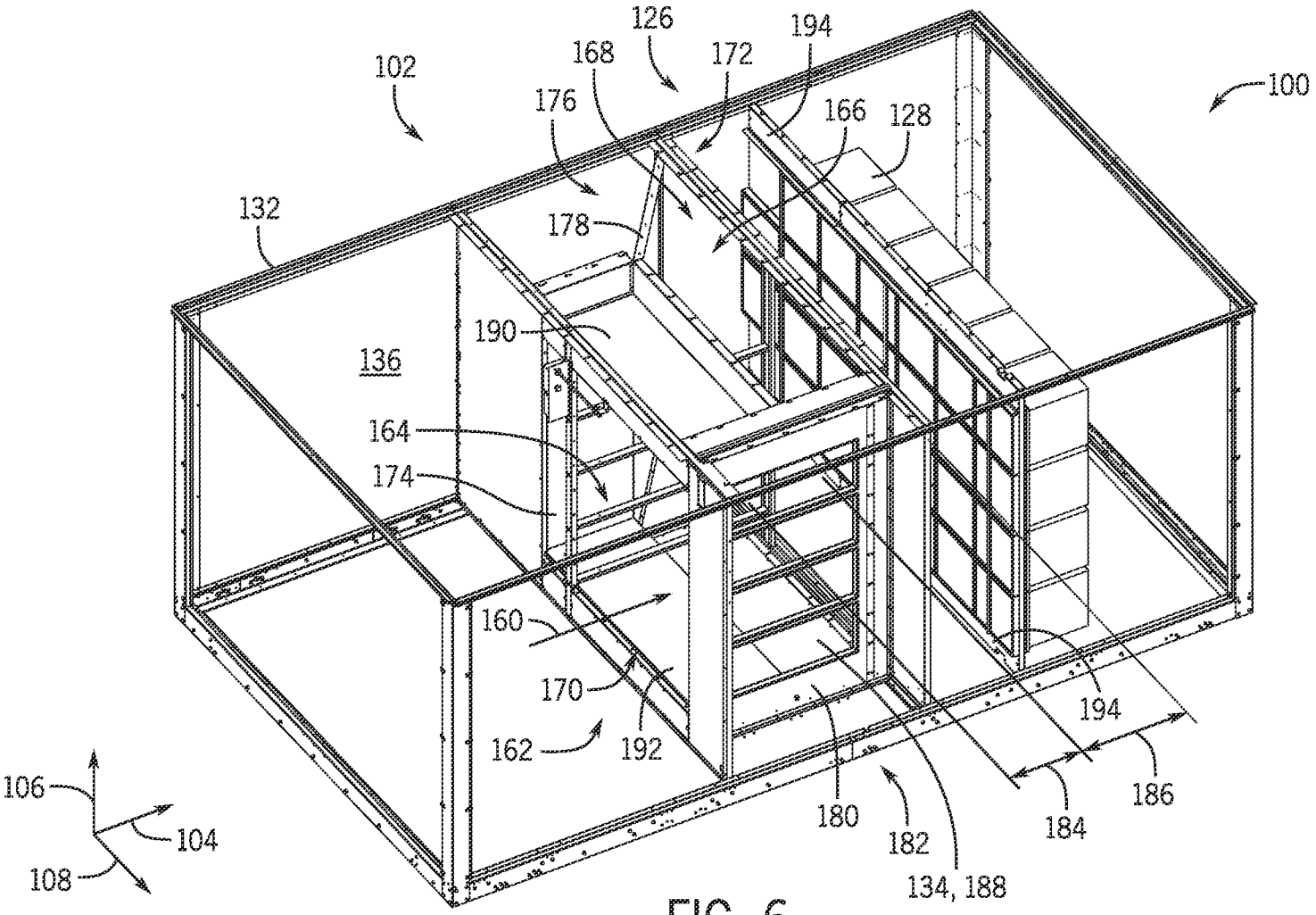
FIG. 6 is a perspective view of an embodiment of a heat exchange section and a filter section of an HVAC system, in accordance with an aspect of the present disclosure.

FIG. 6 is a perspective view of an embodiment of the heat exchange section 102 and the filter section 126 of the HVAC system 100. Certain components, such as the heat exchanger 124 and the outer panels 134, are not shown in the illustrated embodiment for visualization purposes. The heat exchange section 102 may include a plurality of panels that define an air flow path 160 through which air (e.g., the intake air, the supply air) may flow through the heat exchange section 102. That is, the plurality of panels of the heat exchange section 102 may be disposed within the internal volume 136 of the housing 132 to define the air flow path 160. As an example, the heat exchange section 102 may include upstream panels 162 defining an upstream portion 164 of the air flow path 160 and downstream panels 166 defining a downstream portion 168 of the air flow path 160. For instance, the upstream panels 162 may define an inlet 170 (e.g., an opening) through which air may be directed into the heat exchange section 102, such as from the blower section 120, and the downstream panels 166 may define an outlet 172 (e.g., an opening) through which air may be discharged from the heat exchange section 102, such as to the filter section 126. Indeed, the filter section 126 may be disposed downstream of the heat exchange section 102, and the array of filters 128 may receive the air flow discharged from the heat exchange section 102 along the air flow path 160.

The heat exchange section 102 may also include side panels defining the upstream portion 164 and the downstream portion 168. For example, the upstream panels 162 may include a first side panel 174 (e.g., an upstream side panel) that defines the upstream portion 164 on a first side 176 (e.g., a first lateral side) of the heat exchange section 102 and/or air flow path 160, and the downstream panels 166 may include a second side panel 178 (e.g., a downstream side panel) that defines the downstream portion 168 on the first side 176. Additionally, a common side panel 180 may define a second side 182 (e.g., a second lateral side), opposite the first side 176, of the heat exchange section 102 and/or air flow path 160. That is, the common side panel 180 may be positioned opposite the first side panel 174 and the second side panel 178 relative to the air flow path 160 (e.g., across the heat exchange section 102), and the common side panel 180 may extend across each of the upstream portion 164 and the downstream portion 168. Thus, the common side panel 180 may at least partially define each of the upstream portion 164 and the downstream portion 168.

As mentioned above, each of the side panels 174, 178, 180 may be positioned within the internal volume 136 of the housing 132 and between (e.g., within) outer panels 134 of the housing 132. As such, a cross-sectional area of the housing 132 taken within a plane formed by the vertical axis 106 and the lateral axis 108 may be greater than respective cross-sectional areas of the upstream portion 164 and the downstream portion 168 taken within a plane formed by the vertical axis 106 and the lateral axis 108. Additionally, the second side panel 178 may extend obliquely (e.g., at an angle) from the first side panel 174, such as outwardly (e.g., laterally, along the lateral axis 108) from the first side panel 174 toward the housing 132 (e.g., one of the outer panels 134) and/or outwardly from the air flow path 160. For this reason, the cross-sectional area of the upstream portion 164 taken within a plane formed by the vertical axis 106 and the lateral axis 108 may be greater than the cross-sectional area of the downstream portion 168 taken within a plane formed by the vertical axis 106 and the lateral axis 108. Additionally, the cross-sectional area of the downstream portion 168 increases (e.g., gradually increases) in a direction of the air flow along the air flow path 160 (e.g., along the longitudinal axis 104). In some embodiments, the first side panel 174 and the common side panel 180 may extend generally parallel to one another, such as along the longitudinal axis 104. As such, along a first dimension 184 (e.g., a first length) of the upstream portion 164, the upstream portion 164 may have a substantially constant cross-sectional area taken within a plane formed by the vertical axis 106 and the lateral axis 108. However, as mentioned above, the second side panel 178 may extend crosswise relative to the first side panel 174 and thus the common side panel 180. As a result, along a second dimension 186 (e.g., a second length) of the downstream portion 168, the downstream portion 168 may have a variable cross-sectional area taken within a plane formed by the vertical axis 106 and the lateral axis 108. For example, in a direction along the second dimension 186 and along the longitudinal axis 104 from the upstream portion 164 toward the outlet 172, the cross-sectional area of the downstream portion 168 may increase.

In some embodiments, one or more of the outer panels 134 may also partially define the downstream portion 168. For example, the downstream portion 168 may be defined by a ceiling panel (not shown) of the outer panels 134 and a base panel 188 of the outer panels 134. Furthermore, the upstream panels 162 may include a first upstream panel 190 (e.g., an upper panel, an upstream upper panel) and a second upstream panel 192 (e.g., a lower panel, an upstream lower panel) defining the upstream portion 164. The first upstream panel 190 may be positioned within the internal volume 136 and may be offset from the ceiling panel (e.g., along the vertical axis 106), and the second upstream panel 192 may be positioned within the internal volume 136 and may be offset from the base panel 188 (e.g., along the vertical axis 106). That is, the first upstream panel 190 may be positioned further inside of the housing 132 with respect to the ceiling panel, and the second upstream panel 192 may be positioned further inside of the housing 132 with respect to the base panel 188. The arrangement of the first upstream panel 190 and the second upstream panel 192 may further reduce the cross-sectional area of the upstream portion 164 of the air flow path 160 relative to that of the downstream portion 168 of the air flow path 160. As a result, a cross-sectional area of the outlet 172 may be greater than a cross-sectional area of the inlet 170.

The increase in cross-sectional area of the air flow path 160 within the heat exchange section 102 may reduce a speed at which air flows along the air flow path 160. That is, the speed of the air flow in the downstream portion 168 may be less than the speed of the air flow in the upstream portion 164. Thus, the downstream portion 168 may diffuse the air flow directed through the heat exchange section 102. For example, the downstream portion 168 may reduce the speed of the air flow to enable the air to flow through the array of filters 128 below a threshold speed. Additionally, in some embodiments, the cross-sectional area of the upstream portion 164 may gradually increase along the air flow path 160, which may enable a more gradual reduction of the speed of the air flow towards the threshold speed. The flow of air through the array of filters 128 at a speed below the threshold speed may limit wear of the array of filters 128 and may reduce a frequency of maintenance operations performed on the HVAC system 100 (e.g., on the array of filters 128), thereby improving efficient operation of the HVAC system 100.

The increased cross-sectional area of the downstream portion 168 may also improve a distribution of air flow across the array of filters 128. By way of example, the array of filters 128 may extend substantially across a width of the housing 132 along the lateral axis 108. The array of filters 128 may additionally or alternatively extend substantially across a height of the housing 132 along the vertical axis 106. In certain embodiments, the filter section 126 may include one or more offset panels 194 (e.g., block-off panels) that may offset the array of filters 128 from the housing 132 (e.g., one or more of the outer panels 134) along the vertical axis 106, such as from the ceiling panel and/or from the base panel 188. For example, the array of filters 128 may extend along the vertical axis 106 between the offset panels 194 instead of between an entirety of the housing 132 (e.g., from the ceiling panel to the base panel 188). However, with respect to the air flow path 160, the inlet 170 may not be aligned with a portion, quantity, or subset of the array of filters 128. Thus, the air flowing through the inlet 170 (e.g., through the upstream portion 164) may not initially flow toward one or more of the array of filters 128. However, with respect to the air flow path 160, the outlet 172 may align with a greater portion, quantity, or subset of the array of filters 128. For example, the second side panel 178 may direct or guide the air flow from the upstream portion 164 toward the portion of the array of filters 128 with which the inlet 170 is not aligned. In this manner, the downstream portion 168 may increase distribution of air flow across the array of filters 128. For instance, the respective speeds of portions of the air flow directed through each filter of the array of filters 128 may be approximately equal to one another and/or may be less variable than in existing systems. As a result, an uneven wear or degradation rate of the filters 128 may be avoided, and fewer maintenance operations may be performed to repair or replace a subset of the array of filters 128.

Figure 7:
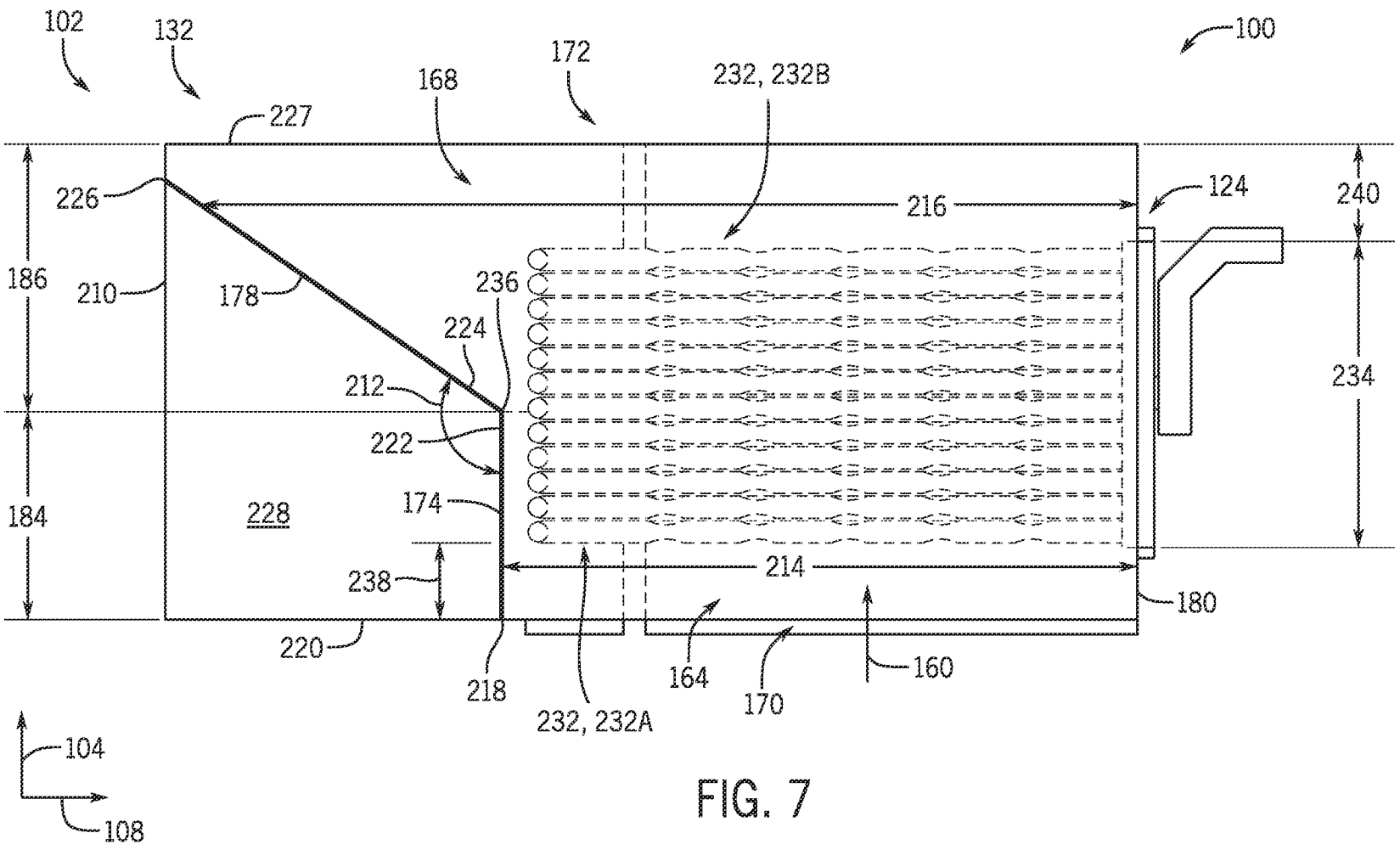
FIG. 7 is a top view of an embodiment of a heat exchange section of an HVAC system, in accordance with an aspect of the present disclosure.

FIG. 7 is a top view of an embodiment of the heat exchange section 102 of the HVAC system 100. In the illustrated embodiment, the first side panel 174 is offset from an outer side panel 210 (e.g., an outer lateral side panel) of the housing 132, and the second side panel 178 extends from the first side panel 174 at an angle 212 toward the outlet 172 and the outer side panel 210 (e.g., at least partially in a downstream direction relative to the flow of air along the air flow path 160). Thus, the second side panel 178 is oriented crosswise (e.g., obliquely) relative to the first side panel 174 and the outer side panel 210. For example, the angle 212 formed between the first side panel 174 and the second side panel 178 may be an obtuse angle between 90 degrees and 150 degrees. In some embodiments, the angle 212 formed between the first side panel 174 and the second side panel 178 may be between 110 degrees and 140 degrees. As such, a first distance 214 (e.g., a first width) spanning between the first side panel 174 and the common side panel 180 may be less than a second distance 216 (e.g., a second width) spanning between the second side panel 178 and the common side panel 180. The orientation of the second side panel 178 may cause air to flow outwardly (e.g., along the lateral axis 108, relative to the longitudinal axis 104) from the upstream portion 164 toward the outer side panel 210 as the air flows along the air flow path 160, thereby reducing (e.g., gradually reducing) the speed of the air flow.

A first end 218 (e.g., an upstream end) of the first side panel 174 may be coupled or attached to a third upstream panel 220 (e.g., a knee wall) defining at least part of the inlet 170. A second end 222 (e.g., a downstream end) of the first side panel 174 may be coupled to a third end 224 (e.g., an upstream end) of the second side panel 178. A fourth end 226 (e.g., a downstream end) of the second side panel 178 may be coupled or attached to the outer side panel 210 and/or to a downstream panel 227 defining the outlet 172. In this manner, the first side panel 174 and the second side panel 178 may define a space 228 between the outer side panel 210 and the side panels 174, 178, and the first side panel 174 and the second side panel 178 may block air flow into the space 228. As such, air may flow through the heat exchange section 102 along the air flow path 160 and between the common side panel 180 and the side panels 174, 178.

A heat exchanger 124 may be positioned within the heat exchange section 102. The heat exchanger 124 may be any suitable heat exchange system configured to transfer heat to and/or from the air flow directed through the heat exchange section 102 along the air flow path 160. For example, the heat exchanger 124 may include tubes 232 that extend between the side panels 174, 178 and the common side panel 180. In the illustrated embodiment, the tubes 232 extend from the common side panel 180 toward the side panels 174, 178 and across the air flow path 160. The tubes 232 may receive a fluid (e.g., a refrigerant, combustion products), and air may be directed across the tubes 232 to exchange heat with the fluid directed through the tubes 232. In some embodiments, the heat exchanger 124 may be disposed at least partially within the upstream portion 164 and at least partially within the downstream portion 168 of the air flow path 160. For example, a first subset of tubes 232A may align with a portion of the first side panel 174 along the air flow path 160 (e.g., along the longitudinal axis 104), and a second subset of tubes 232B may align with a portion of the second side panel 178 along the air flow path 160 (e.g., along the longitudinal axis 104). As such, a dimension 234 (e.g., a length or a depth extending along the longitudinal axis 104) of the heat exchanger 124 may extend across both the upstream portion 164 and the downstream portion 168 of the air flow path 160.

For this reason, an interface 236 at which the second end 222 of the first side panel 174 is coupled to the third end 224 of the second side panel 178 is positioned within the dimension 234 of the heat exchanger 124 along the longitudinal axis 104. In certain embodiments, the interface 236 may be positioned approximately midway along the dimension 234. As such, the first subset of tubes 232A may include a first quantity of the tubes 232 that is substantially equal to (e.g., within one tube of, within two tubes of, within three tubes of) a second quantity of the tubes 232 included in the second subset of tubes 232B. In an example, the heat exchanger 124 may include twelve total tubes 232, and each of the first subset of tubes 232A and the second subset of tubes 232B may include six tubes 232. In another example, the heat exchanger 124 may include twelve total tubes 232, one of the first subset of tubes 232A or the second subset of tubes 232B may include five tubes 232, and the other of the first subset of tubes 232A or the second subset of tubes 232B may include seven tubes 232. The first side panel 174 may extend along the first subset of tubes 232A (e.g., along the dimension 234 of the heat exchanger 124), and the second side panel 178 may extend along and away from the second subset of tubes 232B (e.g., crosswise to the dimension 234).

The orientation of the first side panel 174 with respect to the heat exchanger 124, such as the proximity or position of the first side panel 174 relative to the first subset of tubes 232A, may force air (e.g., intake air) to flow across the first subset of tubes 232A in the upstream portion 164 at a target speed to enable efficient heat exchange between the air and the first subset of tubes 232A. For example, flow of air at the target speed across the first subset of tubes 232A may condition (e.g., heat) the air flow to a target temperature and/or enable heat transfer between the fluid within the first subset of tubes 232A and the flow of air at a desired heat transfer rate. The target speed may be greater than the threshold speed that may cause excessive wear to the array of filters 128. However, the orientation of the second side panel 178 with respect to the heat exchanger 124, such as the extension of the second side panel 178 away from the second subset of tubes 232B, may reduce the speed of the air from the target speed to below the threshold speed during flow of the air along the air flow path 160 (e.g., within the downstream portion 168). As such, the supply air generated via air flow across the heat exchanger 124 may be discharged from the heat exchange section 102 at a speed that mitigate or avoids excessive wear to the array of filters 128. Thus, the first side panel 174 and the second side panel 178 may enable efficient conditioning of air and reduce wear of the array of filters 128.

The first side panel 174 may span the first dimension 184 of the upstream portion 164. For example, the first dimension 184 may extend a distance spanning from the third upstream panel 220 (e.g., the inlet 170, a knee wall) to the interface 236 along the longitudinal axis 104. Thus, the first dimension 184 may include a summation of an offset distance 238 extending from the third upstream panel 220 to an upstream edge of the first subset of tubes 232A and approximately half of the dimension 234 of the heat exchanger 124. Additionally, the second dimension 186 may extend a distance spanning from the interface 236 to the downstream panel 227 (e.g., the outlet 172) along the longitudinal axis 104. Thus, the second dimension 186 may include a summation of an offset distance 240 extending from the downstream panel 227 to a downstream edge of the second subset of tubes 232B and approximately half of the dimension 234 of the heat exchanger 124. In certain embodiments, the second dimension 186 may be greater than the first dimension 184. In such embodiments, the heat exchanger 124 may be positioned more proximate to the inlet 170 than to the outlet 172 along the longitudinal axis 104. In additional or alternative embodiments, the first dimension 184 may be greater than the second dimension 186, and the heat exchanger 124 may therefore be positioned more proximate to the outlet 172 than to the inlet 170 along the longitudinal axis 104. In further embodiments, the first dimension 184 may be approximately equal to the second dimension 186, and the heat exchanger 124 may therefore be positioned substantially midway between the inlet 170 and the outlet 172. The positioning of the heat exchanger 124 relative to the inlet 170 and the outlet 172 may enable efficient operation to condition air directed through the heat exchange section 102. For example, the position of the heat exchanger 124 within the heat exchange section 102 (e.g., relative to the upstream portion 164 and the downstream portion 168 of the air flow path 160) may enable operation of the heat exchanger 124 to condition the air flow with a desired heat transfer rate, to condition the air flow to a desired temperature, and so forth. Additionally, the offset distance 240 (e.g., 50 centimeters or 20 inches, 36 centimeters or 14 inches, 25 centimeters or 10 inches) between the heat exchanger 124 and the outlet 172 may enable sufficient distribution of air across or within the downstream portion 168, thereby enabling a desirable reduction of the speed of the air flow directed through the downstream portion 168 and prior to the air flow passing through the array of filters 128.

Figure 8:
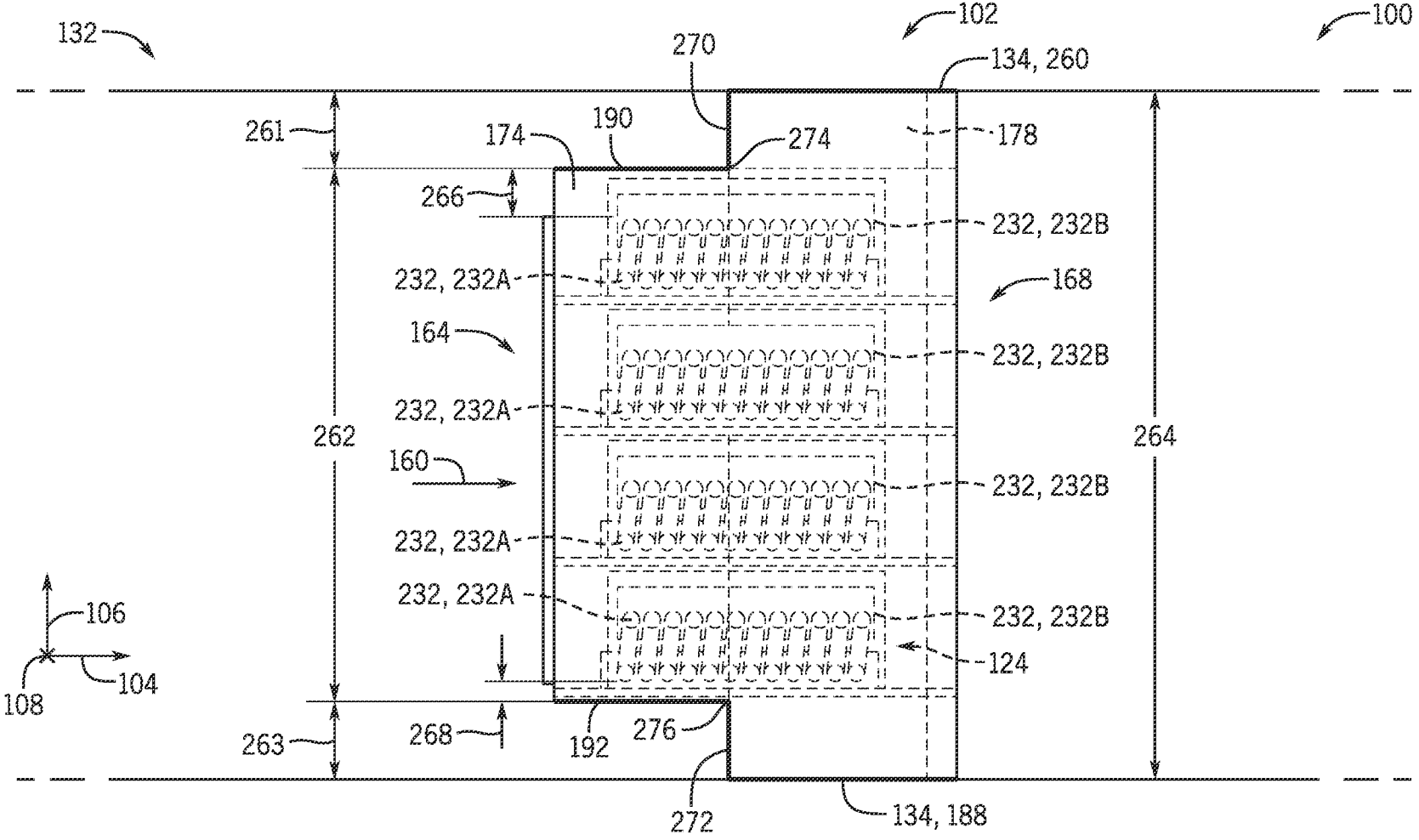
FIG. 8 is a side view of an embodiment of a heat exchange section of an HVAC system, in accordance with an aspect of the present disclosure.

FIG. 8 is a side view of an embodiment of the heat exchange section 102 of the HVAC system 100. As described above, the first upstream panel 190 and the second upstream panel 192 may at least partially define the upstream portion 164, and outer panels 134 may at least partially define the downstream portion 168. For instance, the base panel 188 and a ceiling panel 260 of the outer panels 134 may define the downstream portion 168. Thus, the first subset of tubes 232A of the heat exchanger 124 may be positioned between the first upstream panel 190 and the second upstream panel 192 (e.g., along the vertical axis 106), and the second subset of tubes 232B of the heat exchanger 124 may be positioned between the base panel 188 and the ceiling panel 260 (e.g., along the vertical axis 106). The first upstream panel 190 and the second upstream panel 192 may be offset from the outer panels 134 with respect to the vertical axis 106. As an example, the first upstream panel 190 may be positioned at a first offset distance 261 from the ceiling panel 260 along the vertical axis 106, and the second upstream panel 192 may be positioned at a second offset distance 263 from the base panel 188 along the vertical axis 106. In this manner, the first upstream panel 190 and the second upstream panel 192 may be positioned more interior within the housing 132 (e.g., more proximate to the heat exchanger 124) relative to the ceiling panel 260 and the base panel 188. For this reason, a first distance 262 between the first upstream panel 190 and the second upstream panel 192 may be less than a second distance 264 between the base panel 188 and the ceiling panel 260. As such, the orientation of the base panel 188 and the ceiling panel 260 with respect to the first upstream panel 190 and the second upstream panel 192 may provide an increased cross-sectional area of the downstream portion 168 of the air flow path 160 relative to the cross-sectional area of the upstream portion 164 of the air flow path 160. Such arrangement of the first upstream panel 190 and the second upstream panel 192 with respect to the base panel 188 and the ceiling panel 260 may further enable a reduction in the speed (e.g., below a threshold or desired speed) of air flowing through the heat exchange section 102. In some embodiments, the first offset distance 261 and the second offset distance 263 may be approximately equal to one another. For example, each of the first offset distance 261 and the second offset distance 263 may be 13 centimeters (5 inches), 26 centimeters (10 inches), or 38 centimeters (15 inches). In alternative embodiments, the first offset distance 261 may be different from the second offset distance 263.

The first upstream panel 190 may also be positioned at a third offset distance 266 from the heat exchanger 124 (e.g., the first subset of tubes 232A, an upper edge of the heat exchanger 124) along the vertical axis 106, and the second upstream panel 192 may be positioned at a fourth offset distance 268 from the heat exchanger 124 (e.g., the first subset of tubes 232A, a lower edge of the heat exchanger 124) along the vertical axis 106. In some embodiments, the third offset distance 266 and the fourth offset distance 268 may be approximately equal to one another. For example, each of the third offset distance 266 and the fourth offset distance 268 may be approximately 5 centimeters (2 inches), 10 centimeters (4 inches), or 15 centimeters (6 inches). Alternatively, the third offset distance 266 and the fourth offset distance 268 may be different from one another. Moreover, each of the first upstream panel 190 and the second upstream panel 192 may be coupled to the outer panels 134. For example, a first intermediate panel 270 may couple the first upstream panel 190 to the ceiling panel 260, and a second intermediate panel 272 may couple the second upstream panel 192 to the base panel 188. In some embodiments, the intermediate panels 270, 272 may be integral to the respective upstream panels 190, 192. That is, the first upstream panel 190 and the first intermediate panel 270 may be a single piece (e.g., formed from a single piece of sheet metal), and/or the second upstream panel 192 and the second intermediate panel 272 may be a single piece. In additional or alternative embodiments, the intermediate panels 270, 272 may be separate from the respective upstream panels 190, 192 and may be coupled to one another, such as via a fastener, a weld, a punch, an adhesive, and so forth.

In the illustrated embodiment, each of the intermediate panels 270, 272 extends along the vertical axis 106. In additional or alternative embodiments, the intermediate panels 270, 272 may extend crosswise to the vertical axis 106, such as at an angle toward the respective outer panels 134. In any case, each of the intermediate panels 270, 272 may extend crosswise to the upstream panels 190, 192, the base panel 188, and the ceiling panel 260 to span the respective offset distances 261, 263 between the first upstream panel 190 and the ceiling panel 260 and between the second upstream panel 192 and the base panel 188. The first intermediate panel 270 may be coupled or attached to the first upstream panel 190 at a first interface 274 (e.g., joint, junction), and the second intermediate panel 272 may be coupled or attached to the second upstream panel 192 at a second interface 276 (e.g., joint, junction).

Furthermore, the first side panel 174 may be aligned with the first upstream panel 190 and/or the second upstream panel 192 along the air flow path 160 (e.g., within the upstream portion 164). In some embodiments, the first interface 274 and/or the second interface 276 may be aligned with the interface 236 between the first side panel 174 and the second side panel 178 along the air flow path 160 (e.g., along the longitudinal axis 104). That is, each of the interface 236, the first interface 274, and the second interface 276 may generally or approximately be positioned within a common plane formed by the vertical axis 106 and the lateral axis 108. The first side panel 174, the common side panel 180, the first upstream panel 190, and the second upstream panel 192 may cooperatively define the upstream portion 164 (e.g., a cross-sectional area of the upstream portion 164), and the second side panel 178, the common side panel 180, the base panel 188, and the ceiling panel 260 may cooperatively define the downstream portion 168 (e.g., a cross-sectional area of the downstream portion 168). Therefore, the interface 236, the first intermediate panel 270 coupling the first upstream panel 190 to the ceiling panel 260, the second intermediate panel 272 coupling the second upstream panel 192 to the base panel 188, the first interface 274 at which the first intermediate panel 270 is coupled to the first upstream panel 190, and/or the second interface 276 at which the second intermediate panel 272 is coupled to the second upstream panel 192 may be positioned between the upstream portion 164 and the downstream portion 168 relative to the air flow path 160 and/or relative to the longitudinal axis 104.

Figure 9:
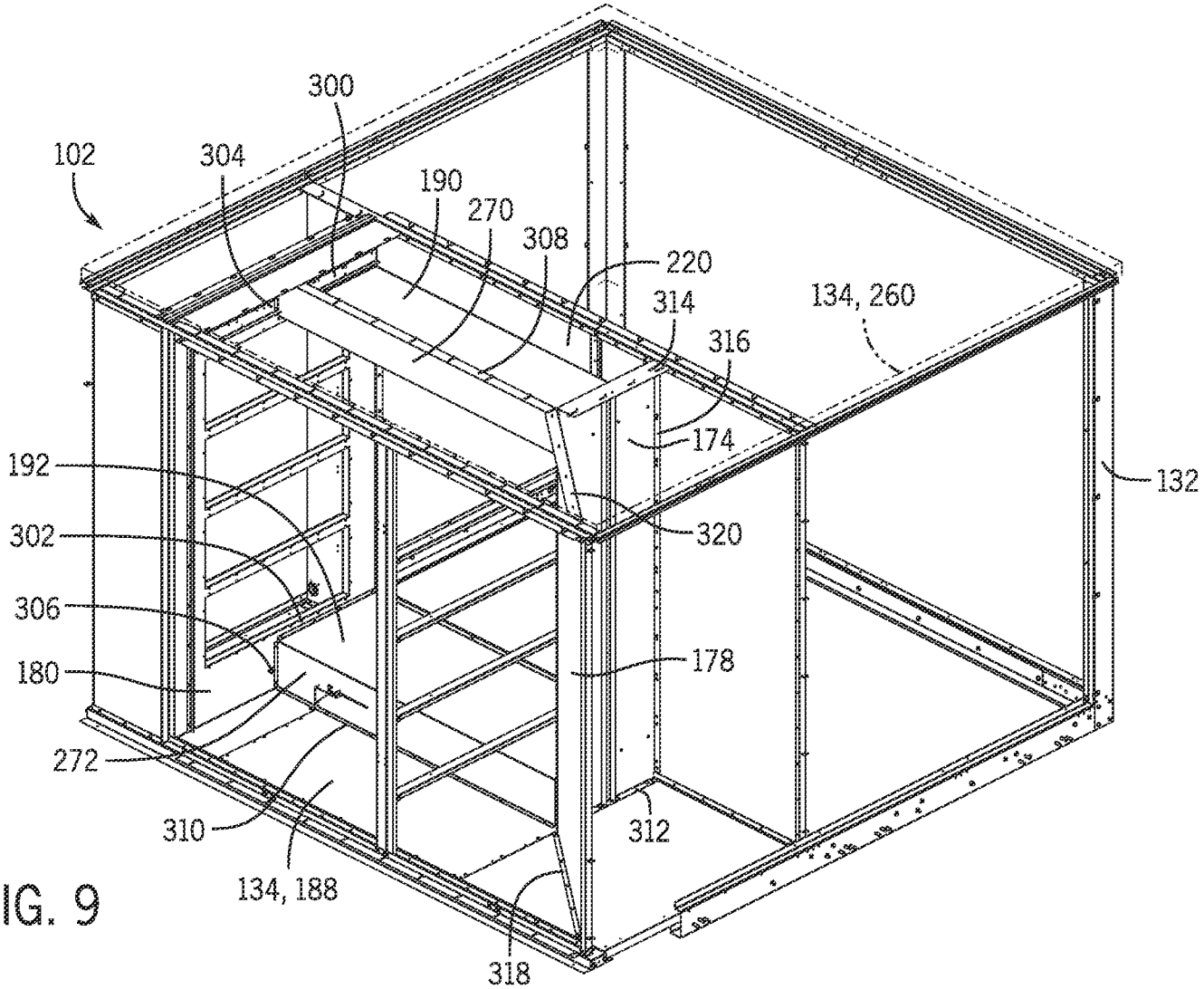
FIG. 9 is a perspective view of an embodiment of a heat exchange section of an HVAC system, in accordance with an aspect of the present disclosure.

FIG. 9 is a perspective view of an embodiment of the heat exchange section 102, illustrating components defining the air flow path 160. Certain components discussed above are not shown for visualization purposes. Each of the upstream panels 190, 192 may be configured to couple to the common side panel 180. For example, a first flange 300 of the first upstream panel 190 may be configured to engage with the common side panel 180 to facilitate coupling between (e.g., insertion of fasteners through) the first upstream panel 190 and the common side panel 180. Similarly, a first flange 302 of the second upstream panel 192 may be configured to engage with the common side panel 180 to facilitate coupling between the second upstream panel 192 and the common side panel 180. Moreover, the first upstream panel 190 and/or the second upstream panel 192 may be configured to couple to the third upstream panel 220 to secure the first upstream panel 190 and the second upstream panel 192 within the heat exchange section 102.

The intermediate panels 270, 272 may also be configured to couple to the common side panel 180. As an example, a first flange 304 of the first intermediate panel 270 and/or a first flange 306 of the second intermediate panel 272 may be configured to engage with the common side panel 180. In addition, the first intermediate panel 270 may be configured to couple to the ceiling panel 260 (shown in phantom lines), and the second intermediate panel 272 may be configured to couple to the base panel 188. For instance, a second flange 308 of the first intermediate panel 270 may be configured to engage with the ceiling panel 260, and a second flange 310 of the second intermediate panel 272 may be configured to engage with the base panel 188.

Further, the first side panel 174 may be configured to couple to the base panel 188, the ceiling panel 260, and/or the third upstream panel 220. For example, a first flange 312 of the first side panel 174 may be configured to engage with the base panel 188, a second flange 314 of the first side panel 174 may be configured to engage with the ceiling panel 260, and a third flange 316 of the first side panel 174 may be configured to engage with the third upstream panel 220. The second side panel 178 may also be configured to couple to the base panel 188 and/or the ceiling panel 260. By way of example, a first flange 318 of the second side panel 178 may be configured to engage with the base panel 188, and a second flange 320 of the second side panel 178 may be configured to engage with the ceiling panel 260. In certain embodiments, a third flange (not shown) of the second side panel 178 may be configured to engage with the outer side panel 210 and further secure the second side panel 178 within the heat exchange section 102. In this way, the heat exchange section 102 may be formed to define the air flow path 160 with the upstream portion 164 and the downstream portion 168, as described herein, while also mitigating leakage of air from the heat exchange section 102 (e.g., the air flow path 160) during operation of the HVAC system 100.

Figure 10:
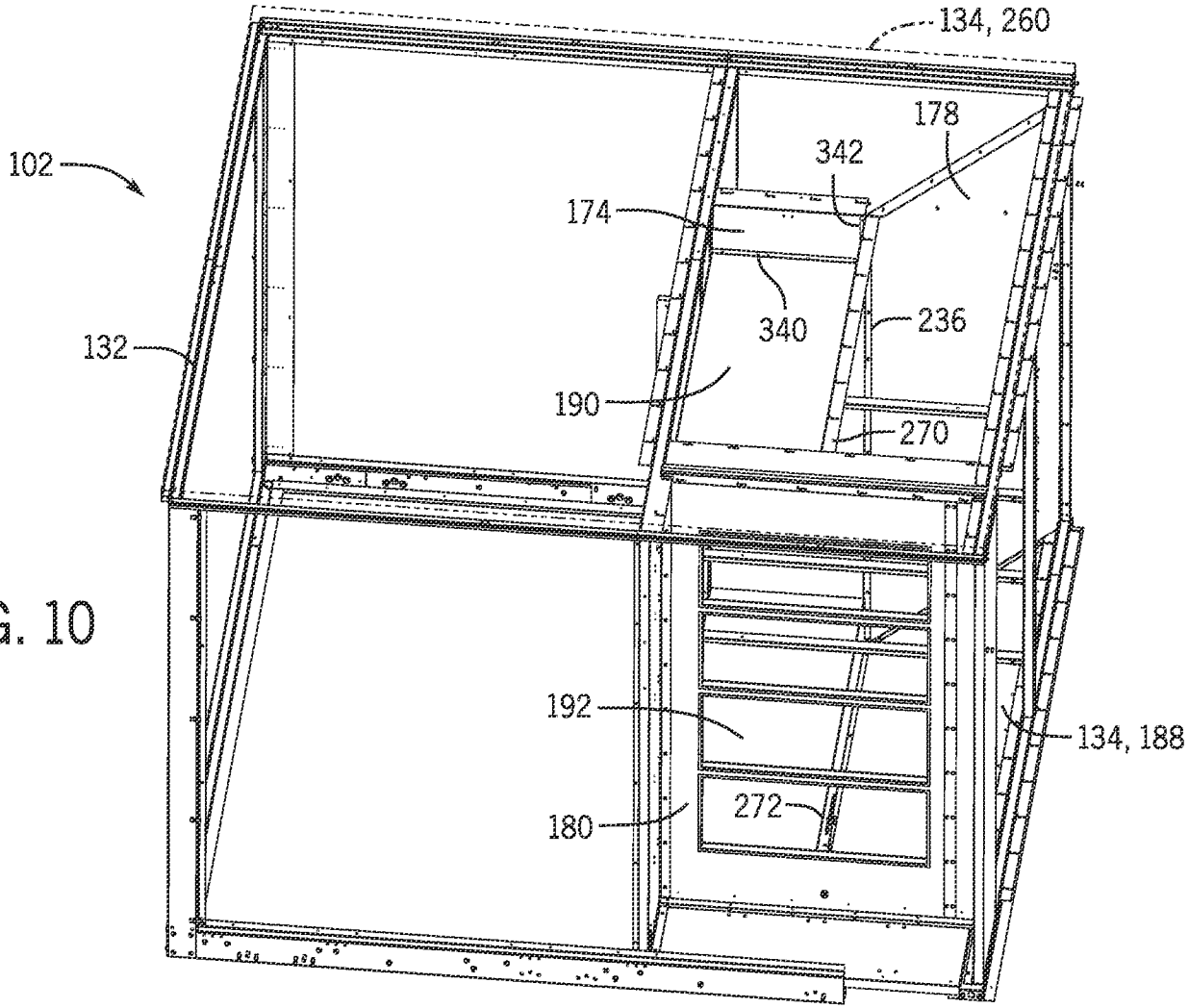
FIG. 10 is a perspective view of an embodiment of a heat exchange section of an HVAC system, in accordance with an aspect of the present disclosure.

FIG. 10 is a perspective view of an embodiment of the heat exchange section 102, illustrating components defining the air flow path 160. Certain components discussed above are not shown for visualization purposes. In some embodiments, each of the upstream panels 190, 192 may be configured to couple to the first side panel 174. For example, a second flange 340 of the first upstream panel 190 may be configured to engage with the first side panel 174, and a second flange (not shown) of the second upstream panel 192 may be configured to engage with the first side panel 174. The intermediate panels 270, 272 may also be configured to couple to the first side panel 174. For instance, a third flange 342 of the first intermediate panel 270 may be configured to engage with the first side panel 174, and a third flange (not shown) of the second intermediate panel 272 may be configured to engage with the first side panel 174. In additional or alternative embodiments, the upstream panels 190, 192 and/or the intermediate panels 270, 272 may be configured to couple to the second side panel 178.

Additionally, the first side panel 174 may overlap with the second side panel 178 along the interface 236. For example, corresponding flanges of the first side panel 174 and of the second side panel 178 may engage with one another along the interface 236. The overlap between the first side panel 174 and the second side panel 178 may facilitate coupling of the first side panel 174 and the second side panel 178 to one another, such as via fasteners inserted through the first side panel 174 and the second side panel 178 along the interface 236.

It should be noted that existing HVAC systems may be retrofitted to incorporate one or more of the features discussed herein. For example, the first side panel 174, the second side panel 178, the common side panel 180, the first upstream panel 190, the second upstream panel 192, the first intermediate panel 270, and/or the second intermediate panel 272 may be incorporated into existing HVAC systems. In some embodiments, one or more of the panels 174, 178, 180, 190, 192, 270, 272 may be part of a kit that may be purchased and distributed for installation (e.g., by a technician) on an existing HVAC system instead of, for example, manufacturing a new HVAC system to replace an entirety of the existing HVAC system. The panels 174, 178, 180, 190, 192, 270, 272 may also be incorporated without substantially modifying other components (e.g., a filter section, a heat exchanger, a housing) of an existing HVAC system and/or changing operation of the HVAC system (e.g., a blower). As such, the benefits discussed herein, such as the reduction of the speed of air discharged from the heat exchange section 102 to provide the benefits described herein, may be more easily achieved in existing HVAC systems.

The present disclosure may provide one or more technical effects useful in the operation of an HVAC system. For example, the HVAC system may include a heat exchange section configured to condition air. The heat exchange section may include multiple panels that define an upstream portion and a downstream portion of an air flow path through which the air may flow. The downstream portion defined by the panels may have a larger cross-sectional area than the cross-sectional area of the upstream portion defined by the panels. As an example, one side panel defining the downstream portion may extend obliquely and outwardly from another side panel defining the upstream portion. As another example, an upper panel and a lower panel defining the upstream portion may be positioned more interior to a housing of the HVAC system as compared to an upper panel and a lower panel (e.g., outer housing panels) defining the downstream portion. The increased cross-sectional area of the downstream portion may reduce the speed of the air flowing through the heat exchange section. For instance, air may initially enter the heat exchange section at a first speed that enables efficient or desired heat exchange (e.g., heat transfer rate) between the air and a heat exchanger disposed in the heat exchange section to condition the air. The increased cross-sectional area of the downstream portion may reduce the speed of the air as the air flows from the upstream portion to the downstream portion, and the heat exchange section may discharge the air at a speed that is less than a second speed (e.g., a threshold speed), lower than the first speed, as a result. In some embodiments, the air may be directed from the heat exchange section to a filter system (e.g., an array of filters), and the flow of air through the filter system at a speed less than the second speed may reduce wear of the filter system. Thus, a useful life of the filter system may be increased, and maintenance operations (e.g., filter replacement) may be performed less frequently. Furthermore, the increased cross-sectional area of the downstream portion may improve distribution of air flow across the filter system and further improve performance (e.g., an efficiency) of the HVAC system. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A heating, ventilation, and/or air conditioning (HVAC) unit, comprising:

a heat exchange section comprising a plurality of panels defining an air flow path through the heat exchange section, wherein the air flow path comprises an upstream portion and a downstream portion separated by an interface, the upstream portion comprises an upstream volume extending from an inlet of the air flow path to the interface, the upstream volume comprises a first cross-sectional area, the downstream portion comprises a downstream volume extending from the interface to an outlet of the air flow path, the downstream volume comprises a second cross-sectional area greater than the first cross-sectional area, and the second cross-sectional area increases from the interface to the outlet; and a heat exchanger comprising an upstream edge disposed within the upstream volume and a downstream edge disposed within the downstream volume, wherein the heat exchanger overlaps with the interface such that a first portion of the heat exchanger is disposed within the first cross-sectional area of the upstream volume and a second portion of the heat exchanger is disposed within the second cross-sectional area of the downstream volume.

2. The HVAC unit of claim 1, wherein the plurality of panels comprises a first side panel defining the upstream volume on a first side of the air flow path and a second side panel defining the downstream volume on the first side of the air flow path, wherein the second side panel extends obliquely from the first side panel.

3. The HVAC unit of claim 2, wherein the heat exchanger comprises a plurality of tubes, a first subset of the plurality of tubes defines the upstream edge and is aligned with the first side panel along the air flow path, and a second subset of the plurality of tubes defines the downstream edge and is aligned with the second side panel along the air flow path.

4. The HVAC unit of claim 1, comprising a housing defining the heat exchange section, wherein the plurality of panels comprises an upstream panel defining the upstream volume, and the upstream panel is offset from an outer panel of the housing.

5. The HVAC unit of claim 4, wherein the upstream panel is a lower panel, and the outer panel is a base panel.

6. The HVAC unit of claim 4, wherein the upstream panel is coupled to the outer panel via an intermediate panel extending crosswise from the upstream panel and the outer panel.

7. The HVAC unit of claim 1, comprising a filter section disposed downstream of the heat exchange section, wherein the filter section comprises an array of filters configured to receive an air flow discharged from the heat exchange section along the air flow path.

8. A heat exchange section of a heating, ventilation, and/or air conditioning (HVAC) unit, comprising:

a plurality of panels defining an air flow path through the heat exchange section;

an upstream portion of the air flow path defined by the plurality of panels, wherein the upstream portion comprises an inlet of the heat exchange section and a first cross-sectional area;

a downstream portion of the air flow path defined by the plurality of panels, wherein the downstream portion comprises an outlet of the heat exchange section and a second cross-sectional area greater than the first cross-sectional area of the upstream portion, wherein the plurality of panels defines an interface between the upstream portion and the downstream portion, the upstream portion defines an upstream volume extending from the inlet to the interface, the first-cross-sectional area of the upstream portion is substantially constant from the inlet to the interface, and the downstream portion defines a downstream volume extending from the interface to the outlet; and a heat exchanger disposed within the air flow path, wherein the heat exchanger comprises an upstream edge disposed within the upstream volume and a downstream edge disposed within the downstream volume.

9. The heat exchange section of claim 8, wherein the plurality of panels comprises an upstream panel defining the inlet of the heat exchange section and a downstream panel defining the outlet of the heat exchange section.

10. The heat exchange section of claim 9, wherein the plurality of panels comprises a first side panel, a second side panel, and an outer side panel, wherein the first side panel is offset from the outer side panel and extends from the upstream panel toward the interface, and the second side panel extends at an angle from the first side panel toward the outlet and the outer side panel.

11. The heat exchange section of claim 9, wherein the outlet is configured to discharge an air flow to a filter section of the HVAC unit.

12. The heat exchange section of claim 8, wherein the second cross-sectional area increases along a length of the downstream portion, and the length extends from the interface to the outlet of the heat exchange section.

13. A heating, ventilation, and/or air conditioning (HVAC) unit, comprising:

a first panel defining an upstream portion of an air flow path through a heat exchange section of the HVAC unit, wherein the upstream portion comprises an inlet of the heat exchange section and an upstream volume comprising a first cross-sectional area, wherein the first panel and the upstream volume each extends in a downstream direction from a first end of the first panel to an interface, and wherein the first cross-sectional area is substantially constant from the inlet to the interface;

a second panel defining a downstream portion of the air flow path, wherein the downstream portion comprises an outlet of the heat exchange section and a downstream volume comprising a second cross-sectional area greater than the first cross-sectional area, the second panel extends from the interface at an oblique angle, relative to the first panel, along the downstream direction to a second end of the second panel, the downstream volume extends from the interface to the second end of the second panel, and the second cross-sectional area of the downstream volume increases from the interface to the outlet; and a heat exchanger disposed within the air flow path, wherein the heat exchanger comprises an upstream edge disposed within the upstream volume and a downstream edge disposed within the downstream volume.

14. The HVAC unit of claim 13, comprising an outer side panel, wherein the first panel is offset from the outer side panel, and the second panel extends from the first panel to the outer side panel.

15. The HVAC unit of claim 13, comprising a common side panel defining each of the upstream volume and the downstream volume, wherein the common side panel is positioned on a side of the air flow path opposite the first panel and the second panel, and a first distance between the common side panel and the first panel is less than a second distance between the common side panel and the second panel.

16. The HVAC unit of claim 15, wherein the heat exchanger is positioned within the air flow path between the common side panel and the first panel and between the common side panel and the second panel.

17. The HVAC unit of claim 13, comprising a housing, wherein the second panel extends toward an outer panel of the housing, and the first panel is offset from the outer panel.

18. The HVAC unit of claim 17, wherein the first panel is an upper panel, the outer panel is a ceiling panel, and the HVAC unit comprises:

a third panel defining the upstream volume; and a fourth panel defining the downstream volume, wherein the third panel is offset from the fourth panel, and the fourth panel is a base panel of the housing.

* * * * *